US007750877B2

(12) United States Patent
Sakai

(10) Patent No.: US 7,750,877 B2
(45) Date of Patent: Jul. 6, 2010

(54) PROGRAM FOR CAUSING COMPUTER TO EXECUTE DISPLAY SYSTEM AND DATA TRANSFER METHOD

(75) Inventor: Mamoru Sakai, Kawasaki (JP)

(73) Assignee: Seiko Epson Corporation (JP)

( * ) Notice: Subject to any disclaimer, the term of this patent is extended or adjusted under 35 U.S.C. 154(b) by 1220 days.

(21) Appl. No.: 11/325,647

(22) Filed: Jan. 4, 2006

(65) Prior Publication Data

US 2006/0197724 A1 Sep. 7, 2006

(30) Foreign Application Priority Data

Mar. 7, 2005 (JP) ..... 2005-062011

(51) Int. Cl.
*G09G 3/36* (2006.01)

(52) U.S. Cl. ..... 345/87; 345/1.2

(58) Field of Classification Search ..... 345/1.1, 345/1.2, 87, 156, 169, 172, 531–538; 710/14, 710/20, 59, 70–74; 711/100, 162
See application file for complete search history.

(56) References Cited

U.S. PATENT DOCUMENTS

2003/0236933 A1 12/2003 Shigeta et al.
2007/0156925 A1 7/2007 Shigeta et al.

FOREIGN PATENT DOCUMENTS

| | | |
|---|---|---|
| CN | 2616923 Y | 5/2004 |
| JP | 2000-284253 | 10/2000 |
| JP | 2001-100703 | 4/2001 |

OTHER PUBLICATIONS

Front page of CN1469251A dated Jan. 2004.

*Primary Examiner*—Richard Hjerpe
*Assistant Examiner*—Mansour M Said
(74) *Attorney, Agent, or Firm*—Harness, Dickey & Pierce, P.L.C.

(57) ABSTRACT

A display system includes a display apparatus having a liquid crystal display screen of displaying images with memory-type liquid crystal and an image data storing portion of storing image data used for image forming; and an image data supplying apparatus including a transfer section of attaining or preparing image data and transferring the image data to said display apparatus, wherein said transfer section is used for forming images displayed in said liquid crystal display screen and transfers at least one of display image data to be destroyed after the image forming and storage image data to be stored in said image data storing portion as data separate from the other.

6 Claims, 7 Drawing Sheets

PROGRAM FOR CAUSING COMPUTER TO EXECUTE DISPLAY SYSTEM AND DATA TRANSFER METHOD

The entire disclosure of Japanese Patent Application No. 2005-62011, filed Mar. 7, 2005, is expressly incorporated by reference herein.

BACKGROUND OF THE INVENTION

1. Field of the Invention

The present invention relates to a program for causing a computer to execute a display system and a data transfer method, and, in particular, relates to an electronic system comprising a display body of displaying images with memory-type liquid crystal.

2. Description of the Prior Art

Currently, a display apparatus in utilization of memory-type liquid crystal capable of consecutive display of images without receiving power supply has been realized for practical use. Such a display apparatus is advantageous for thinning display screens and therefore is utilized as a compact and lightweight electronic book. In addition, since it can be carried without any battery etc. to be mounted thereon and in a state of being disconnected from a power supply, it is being utilized as media of displaying drawings and characters (hereinafter to be referred to as image) outputted from a personal computer (PC).

An electronic book or a display apparatus in utilization of memory-type liquid crystal to be utilized as media of displaying images is also called electronic paper.

As prior art of utilizing electronic paper as an electronic book, there is one that is provided with a memory capable of storing data for forming images onto electronic paper (image data) covering the whole pages of a book. An electronic book reads out stored image data every predetermined data amount with operation of a user. The user can switch pages of a book like he turns pages of a book to take a look at pages of a book.

In addition, as another prior art in utilization of electronic paper, JP-A-2000-284253 (herein after referred to as Patent Document 1) can be nominated for example. Patent Document 1 employs, as main display, a display such as TFT (Thin Film Transistor) etc. that a PC comprises and utilizes electronic paper for complementary subdisplay. In Patent Document 1, electronic paper used for a subdisplay displays only images outputted by a PC likewise paper media where images are printed, and does not store contents therein.

JP-A-2000-284253 is an example of related art.

SUMMARY

Electronic paper is anticipated to be used for general purposes more and more in the future. Therefore, it is desirable that the same one electronic paper is made utilizable in a variety of occasions likewise paper. However, the above described prior art used to use electronic paper as an electronic book alone or specifically for only a single function such as PC's output media.

The present invention was attained in view of the above described points, and an object thereof is to provide a program for causing a computer to execute a display system, that is capable of switching the method of data transfer to electronic paper depending on a utility aspect such as PC's output media or electronic book and of operating in conformity with the aspect of electronic paper, and a data transfer method thereof.

In order to solve the above described problems, a display system of the present invention is a display system comprising a display apparatus having a liquid crystal display screen of displaying images with memory-type liquid crystal and an image data storing portion of storing image data used for image forming and an image data supplying apparatus including a transfer section of attaining or preparing image data and transferring the image data to the above described display apparatus, wherein the above described transfer section is used for forming images displayed in the above described liquid crystal display screen and transfers at least one of display image data to be destroyed after the image forming and storage image data to be stored in the above described image data storing portion as data separate from the other.

According to such an invention, image data can be transferred from a transfer section that an image data supplying apparatus comprises a display apparatus having a liquid crystal display screen of displaying images with memory-type liquid crystal and an image data storing portion of storing image data used for forming images. And, at this time, after having been used for forming image to be displayed on the liquid crystal display screen, at least one of the display image data to be destroyed and the image data to be stored in the image data storing portion are transferred independently from the other, only the image data to be displayed are transferred in case of using the liquid crystal display screen for a subdisplay of a PC etc., and time or the process required for transfer and storage can be omitted.

In addition, in case of using the liquid crystal display screen for electronic book etc. alone, only the image data to be stored are transferred, and time or the process required for displaying images can be omitted.

Moreover, transferring the storage image data separately from the display image data, display and storage of the image data can be executed concurrently. Thereby, the time period from the time when a user instructs transfer of image data to the time when an image is displayed can be reduced further than the configuration of proceeding with display after the image data are once stored, and therefore responsiveness of the display system to a user can be increased.

The present invention like this can provide a display system capable of switching methods of data transfer to electronic paper depending on a utilization aspect such as output media of a PC or an electronic book and operating in a fashion suitable to an aspect of the electronic paper.

In addition, the display system of the present invention is characterized in that the above described image data supplying apparatus is a personal computer comprising a display screen and, in case of the above described image data being configured on a page-by-page bases, the above described transfer section transfers display image data to the above described display apparatus with a data amount displayed on the above described display screen as one page as a unit.

According to such an invention, image on a page being displayed on the display screen presently can be caused to be displayed on a liquid crystal display screen. Such a configuration can cause a user to select an image that he or she desires to display on a liquid crystal display screen as he or she watches the image on the display screen and thus operability of the display system can be increased.

In addition, the present invention is characterized in that the above described image data supplying apparatus is a personal computer comprising a display screen and the above described transfer section transfers, to the above described display apparatus, display image data in a data amount displayable as one screen on the above described display screen as a unit.

According to such an invention, images being displayed on the display screen presently can be caused to be displayed on a liquid crystal display screen. Such a configuration can cause a user to select an image that he or she desires to display on a liquid crystal display screen as he or she watches the image on the display screen and thus operability of the display system can be increased.

In addition, the display system of the present invention is characterized in that the above described image data supplying apparatus further comprises a transfer mode selecting portion of selecting a mode of transferring image data with the above described transfer section, and the above described transfer mode selecting portion has a consecutive transfer section of selecting display and storage transfer mode that transfers the above described display image data and the above described storage image data consecutively.

According to such an invention, in the image data supplying apparatus, a mode of transferring image data with the above described transfer section can be selected. In addition, since a display and storage transfer mode of consecutively transferring display image data for forming images to be displayed on a liquid crystal display screen and storage image data to be stored in the image data storing portion can be selected, both of the display image data and the storage image data can be transferred with just one-time operation.

In addition, the display system of the present invention is characterized in that, in case of the above described display and storage transfer mode having been selected, the above described consecutive transfer section transfers the above described storage image data subsequent to transfer of the above described display image data.

According to such an invention, images can be drawn on a liquid crystal display screen based on the display image data or image data can be stored while an image is being updated, and the time period required for image data display and storage that annoys a user can be reduced further.

In addition, a program for causing a computer to execute an image data transfer method of the present invention is a program for causing a computer to execute an image data transfer method of transferring image data to a display apparatus having a liquid crystal display screen of displaying images with memory-type liquid crystal, characterized by comprising a display image data transfer step of transferring display image data that are used for forming images to be displayed on the above described liquid crystal display screen and are destroyed subsequent to the image forming to the above described display apparatus and a storage image data transfer step of transferring storage image data to be stored in the above described display apparatus to the above described display apparatus subsequent to transfer of display image data by the above described display image data transfer step.

According to such an invention, after display image data for forming images to be displayed on a liquid crystal display screen has been transferred to a display apparatus, storage image data to be stored in the above described display apparatus can be transferred to the display apparatus.

Thereby display and storage of the image data can be executed concurrently. Thereby, the whole time period required for storage and display of image data can be reduced further than the configuration of proceeding with display after the image data are once stored. In addition, images can be drawn on a liquid crystal display screen based on the display image data or image data can be stored while an image is being updated, and the time period required for image data display and storage that annoys a user can be reduced further.

The present invention like this can provide a program for causing a computer to execute a data transfer method of a display system capable of switching methods of data transfer to electronic paper depending on the utilization aspect such as output media of a PC or an electronic book and operating in a fashion suitable to the aspect of the electronic paper.

In addition, a program of the present invention for causing a computer to execute an image data transfer method of the present invention is characterized in that, in the case where display image data are transferred from a personal computer comprising a display screen to the above described display apparatus and display image data to be transferred are configured on a page unit basis, in the above described display image data transfer step, image data covering one page being displayed on the above described display screen are transferred.

According to such an invention, images of the page being displayed on the display screen presently can be caused to be displayed on a liquid crystal display screen. Such a configuration can cause a user to select an image that he or she desires to display on a liquid crystal display screen as he or she watches the image on the display screen and thus operability of the display system can be increased.

DETAILED DESCRIPTION OF THE PREFERRED EMBODIMENTS

An embodiment of a program for causing a computer to execute a display system and a data transfer method related to the present invention will be described with reference to drawings as follows.

Figure 1:
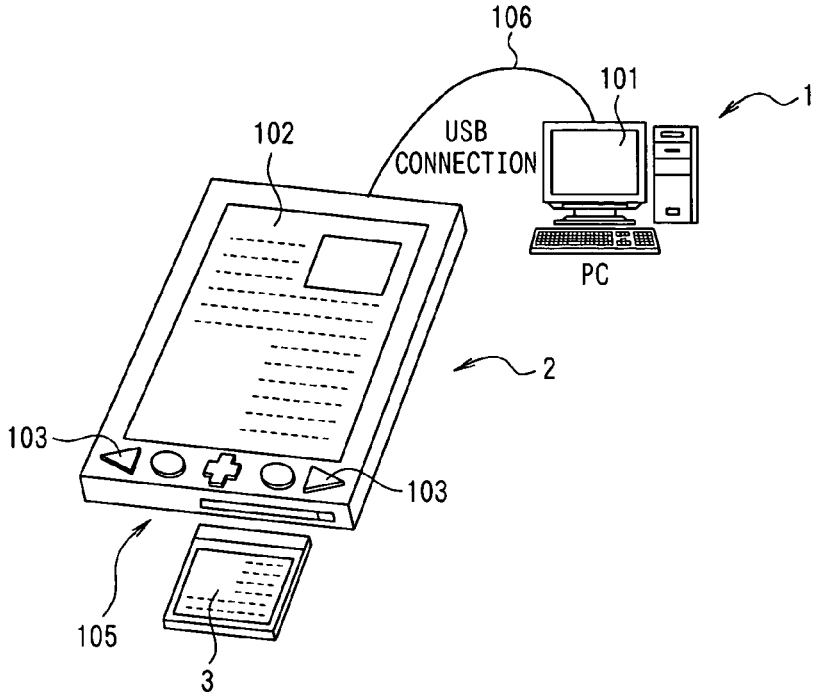
FIG. 1 is a drawing showing appearance of a display system of an embodiment of the present invention.

FIG. 1 is a drawing showing appearance of a display system of the present embodiment. A display system of the present embodiment is configured by comprising a display apparatus in use of memory-type liquid crystal and a general-purpose PC (Personal Computer) 1. The depicted display apparatus is so-called electronic paper 2 or thin display apparatus, and comprises a memory-type display screen 102 of displaying images with memory-type liquid crystal such as cholesteric liquid crystal etc.

In addition, the electronic paper 2 comprises an input portion 105. The input portion 105 is used at the time when a user operates contents displayed in the memory-type display screen 102 in the case where the electronic paper 2 is used alone separately from the PC 1.

When the electronic paper 2 is used as an electronic book, the input portion 105 of the present embodiment comprises a page-turning button 103 of causing the next page to be displayed or causing the preceding page to be displayed and moreover comprises an arrow key of changing positions of displaying images on a screen and a button for inputting entry of operation and the like.

Moreover, the electronic paper 2 of the present embodiment can be equipped with a memory card 3 as an attachment and the memory card 3 is a memory of storing image data used for forming images. The memory card 3 functions as an image data storing portion of the present embodiment.

On the other hand, the PC 1 comprises a display 101. The display 101, which is a non-memory-type liquid crystal display screen such as TET etc., updates images rapidly as it receives power supply all the time.

The electronic paper 2 is connected to the PC 1 with a USB (Universal Serial Bs) cable 106. In the display system of the present embodiment, image data transfer from the PC 1 to the electronic paper 2 is all implemented with a USB cable 106. The USB cable 106 configures a transfer section of the present embodiment together with a printer driver to be described later.

Figure 2:
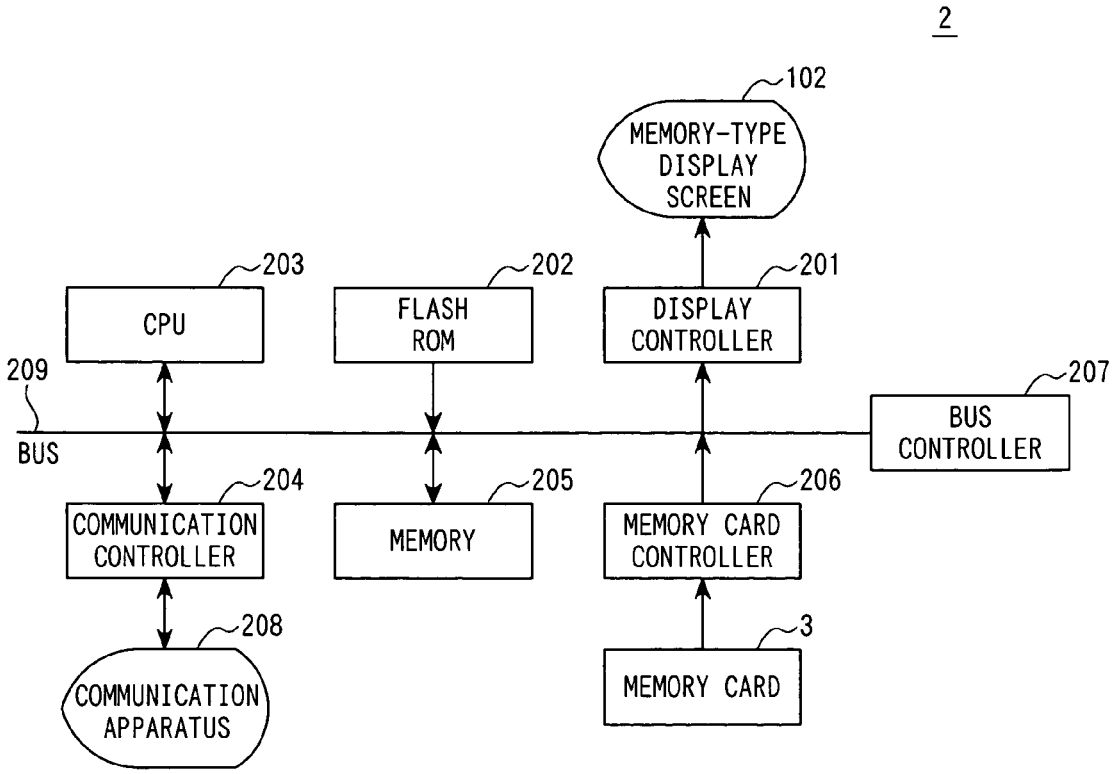
FIG. 2 is a drawing for describing a hardware configuration of the electronic paper shown in FIG. 1.

FIG. 2 is a drawing for describing a hardware configuration of the electronic paper 2 shown in FIG. 1. The electronic paper 2 is configured by a CPU (Central Processing Unit) 203, a FLASH ROM 202, a display controller 201 of controlling the memory-type display screen 102, a communication controller 204, a memory 205 and a memory card controller 206 of controlling the memory card 3 being connected to a bus 209. The bus 209 is controlled by the bus controller 207.

The electronic paper 2 is holistically controlled by the CPU 203. The FLASH ROM 202 is a large capacity memory of storing data used for controlling operations of the CPU 203. The memory 205 is a memory of storing data as well as programs etc. used for controlling operations of the CPU 203. The display controller 201, which is a driver of the memory-type display screen 102, selectively applies voltage to not shown electrodes of the memory-type display screen 102 and controls image display in the memory-type display screen 102. The communication controller 204 has a configuration of controlling a communication apparatus 208 of operating communication between the electronic paper 2 and the PC 1 and the communication apparatus 208, and the communication apparatus 208 comprises the USB cable 106.

Figure 3:
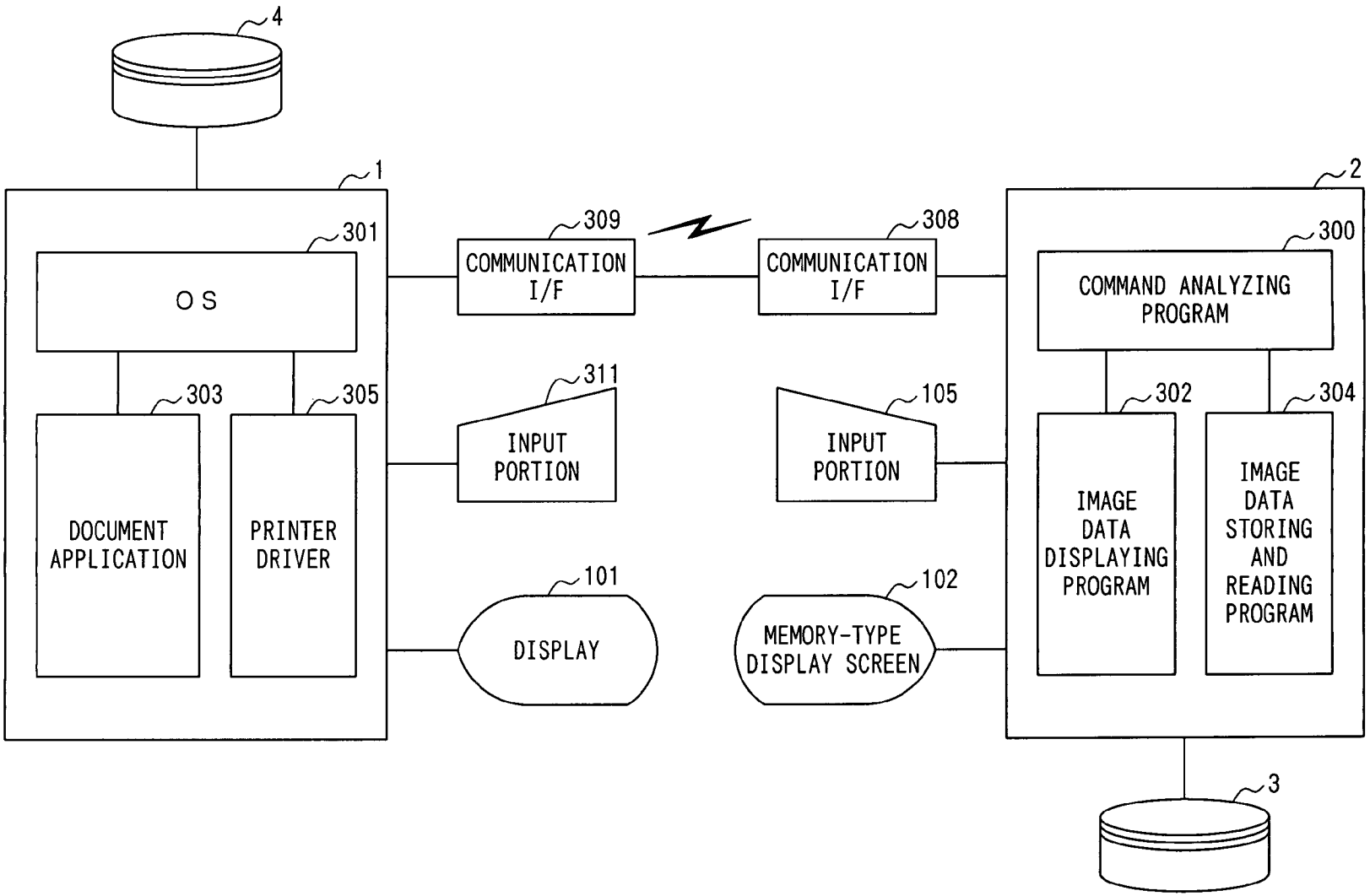
FIG. 3 is a drawing for describing a software configuration of the PC shown in FIG. 1 and the electronic paper shown in FIG. 2.

FIG. 3 is a drawing for describing a software configuration of the PC 1 shown in FIG. 1 and the electronic paper 2 shown in FIG. 2. The PC 1 comprises a printer driver 305, a document application 303 of preparing a document, a printer driver 305 and an OS (Operating System) 301 of operating the document application 303. In addition, the PC 1 is connected to a recording media such as CD (Carrier Detect) etc. or a document file 4 present on a network and can utilize image data stored in the document file 4.

Moreover, the PC 1 comprises, in addition to the display 101, an inputting portion 311 such as a keyboard and a mouse, etc. and a communication I/F 309 of transferring image data prepared with the document application 303 or image data derived from the document file 4 to the electronic paper 2.

The document application 303 forms images displayed on the memory-type display screen 102 and prepares image data (display image data) to be destroyed subsequent to this image forming and image data (storage image data) to be stored in the memory card 3 as a document for storage respectively. The printer driver 305, which is configured to control the electronic paper 2, transfers at least one of the display image data and the storage image data via the USB cable 106 independently from the other.

Here, a passage "transfer at least one of the display image data and storage image data independently from the other" means that there are a case of transferring only display image data to the electronic paper 2, a case of transferring only storage image data to the electronic paper 2 and a case of transferring display image data and storage image data separately and independently. In addition, the term "separate and independent" in the present embodiment means that display image data are those to be destroyed after having been used for drawing images that are never stored in the memory card 3 and that, after having been stored in the memory card 3, storage image data are never used for drawing images besides the case of being read out from the memory card 3.

On the other hand, the electronic paper 2 comprises a command analyzing program 300, an image data displaying program 302 and an image data storing and reading program 304. The command analyzing program 300 analyzes image data transferred from the PC 1 side and determines whether they are display image data or storage image data and the like. The image data displaying program 302 is a program of causing a memory-type display screen 102 to display the display image data. In addition, the image data storing and reading program 304 is a program for storing the storage image data into a memory card 3.

In addition, the electronic paper 2 is operable according to instruction that a user has inputted via an input portion 105 shown in FIG. 1 as well, and in the present embodiment, in connection with the PC 1, control information etc. is inputted from the PC 1 side. The electronic paper 2 therefore comprises a communication I/F 308, and receives the control information etc. from the PC 1.

The above described configuration operates as follows. That is, in the PC 1, in the case where a user transmits to the electronic paper 2 image data derived or prepared by the PC 1, the printer driver 305 displays onto the display 101 an operation screen for causing the user to select whether he or she transmits the image data as display image data or storage image data.

Figure 4:
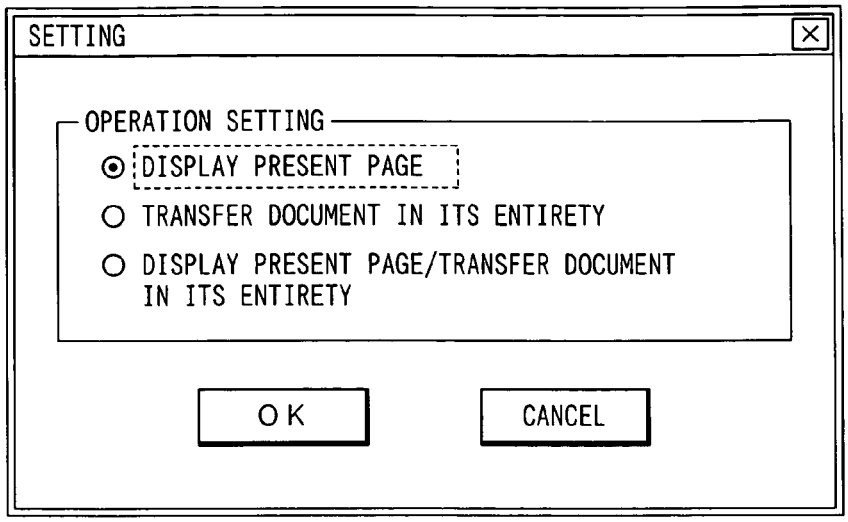
FIG. 4 is a drawing showing an operation screen displayed on a display of an embodiment of the present invention.

FIG. 4 is a drawing of exemplifying such an operation screen. In the present embodiment, image data being displayed with the PC 1 are to be treated on a page unit basis. In the depicted operation screen, any operation mode of "display present page", "transfer document in its entirety" and "display present page/transfer document in its entirety" can be selected.

In the case where a user has selected the operation mode of "display present page", the printer driver 305 transfers, to the electronic paper 2 as display image data, the image data presently being displayed on the display 101 as one page. The format of the display image data is a format that can undergo image forming on the electronic paper 2. The display image data will never be stored into the memory card 3 but deleted by updating after having been displayed on the memory-type display screen 102.

The operation mode of "display present page" is used in the case where a user uses the electronic paper 2 as a complementary display while he or she works with the PC 1 and the like. The electronic paper 2 can retain these image data without consuming the electric power after having caused the memory-type display screen 102 to display the image data. Therefore, according to such an operation mode, in spite of low power consumption, a display system with a lot of image screens in number can be configured.

In addition, in the case where a user has selected the operation mode of "transfer document in its entirety", the printer driver 305 transfers, to the electronic paper 2 as storage image data, the image data of all the pages of document being displayed on the PC 1. The format of the storage image data may be any type if it is a format that can be converted into displayable data as images on the electronic paper 2. As a format of storage image data, bitmap images, HTML, Word documents, PDF (trademark) etc. can be considered.

The operation mode of "transfer document in its entirety" is used in the case where electronic paper 2 is used as a stand-alone electronic book etc. and the like. Here, in such a case, the electronic paper 2 will require supply of electric power from cells that it comprises itself or an external power supply. However, the electronic paper 2 will require supply of electric power only at the time of updating images, and will not consume electric power for retaining images that have been displayed once. Therefore, according to such an operation mode, the electronic paper 2 incorporated in a display system can be separated and used as a stand-alone electronic book with low power consumption.

In addition, in the case where a user has selected the operation mode of "display present page/transfer document in its entirety", the printer driver 305 transfers consecutively to the electronic paper 2 the display image data of images being presently displayed and storage image data of all the documents being presently displayed.

In the present embodiment, at first, display image data covering one page are transferred. And, subsequent to transfer of the display image data, image data of all pages of a document are transferred, as storage image data, to the electronic paper 2.

According to such an operation, since updating starts in advance, no transfer of storage data will decrease operability of the electronic paper 2. In addition, the speed of updates of the memory-type display screen 102 is comparatively slow, and at least a part of the storage image data can undergo transfer and storage during updating. Therefore, in the display system of the present embodiment, the level of annoyance of a user on a time period required for transfer and storage of the storage data will comparatively get low.

In addition, according to such an operation mode, a user can display the image, that was displayed in the past, again rapidly also in case of carrying the electronic paper 2 separately from the PC 1.

Here, the present embodiment will not be applied only to the case where image data are configured on a page unit basis. That is, in the case where the image data on screen in the PC 1 provide with no concept on page, the display image data for the image being presently displayed on the display 101 can be transferred to the electronic paper 2 as well.

Figure 5:
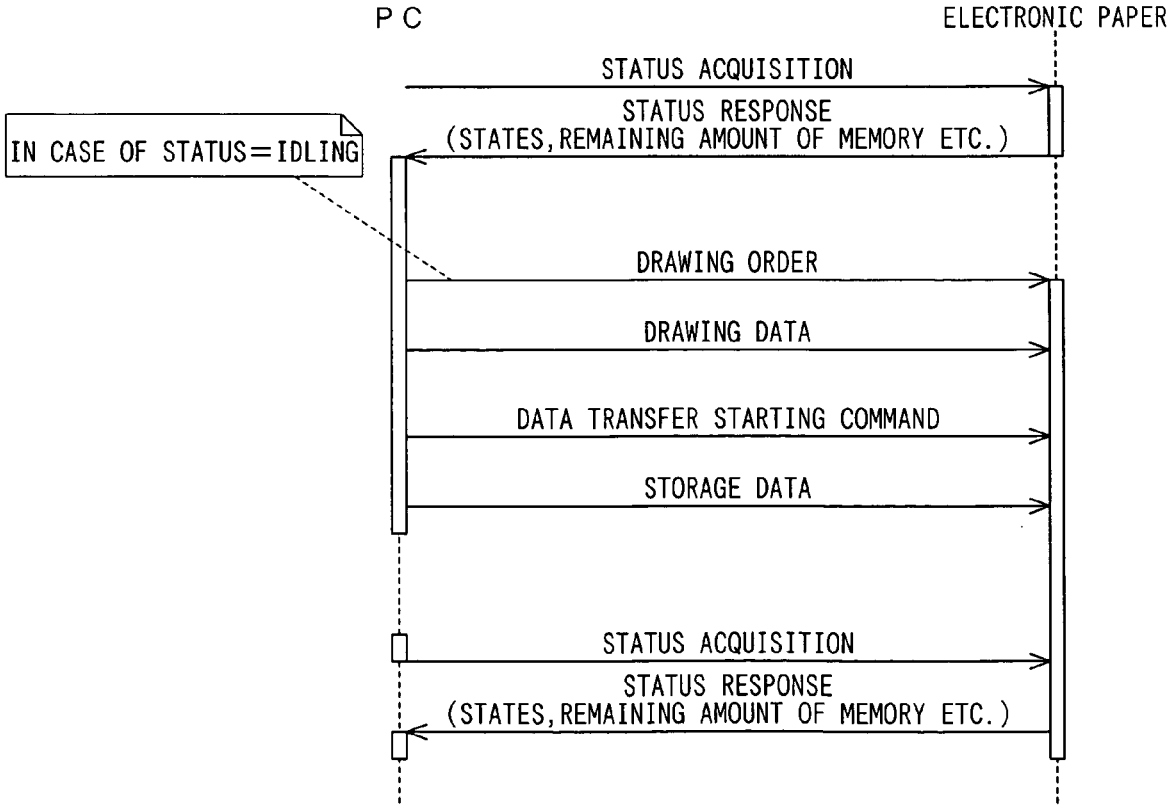
FIG. 5 is a drawing for describing communication of an embodiment of the present invention between a PC and electronic paper.

FIG. 5 is a drawing for describing communication between the PC 1 and the electronic paper 2. The electronic paper 2 has stored the status of indicating the state of itself (apparatus). The stored status are updated corresponding with changes in the state such as in the midst of drawing an image or on standby (idling state). The PC 1 communicates to and instructs the electronic paper 2 by the communication I/F 309 to notify of the status back. This instruction is indicated as STATUS AQUISITION in the drawing.

The electronic paper 2 in receipt of the instruction communicates to the PC 1 and notifies it of the status. This communication is described and indicated as STATUS RESPONSE in the drawing. In the status response of the present embodiment, not only the state of the electronic paper 2 but also the remaining amount of memory of the memory card 3 will be notified to the PC 1 side. In case of transfer of the storage image data for all the pages of the document to the electronic paper 2 in the above described operation mode, the data amount of the storage image data to be transferred may be compared with the remaining amount of memory of the memory card 3 to control data transfer.

Here, "control of data transfer" is considered to be display of error message on the display 101 by PC 1 in the case, for example, where the remaining amount of memory in the memory card 3 is less than the data amount of the storage data amount and the like.

Figure 6:
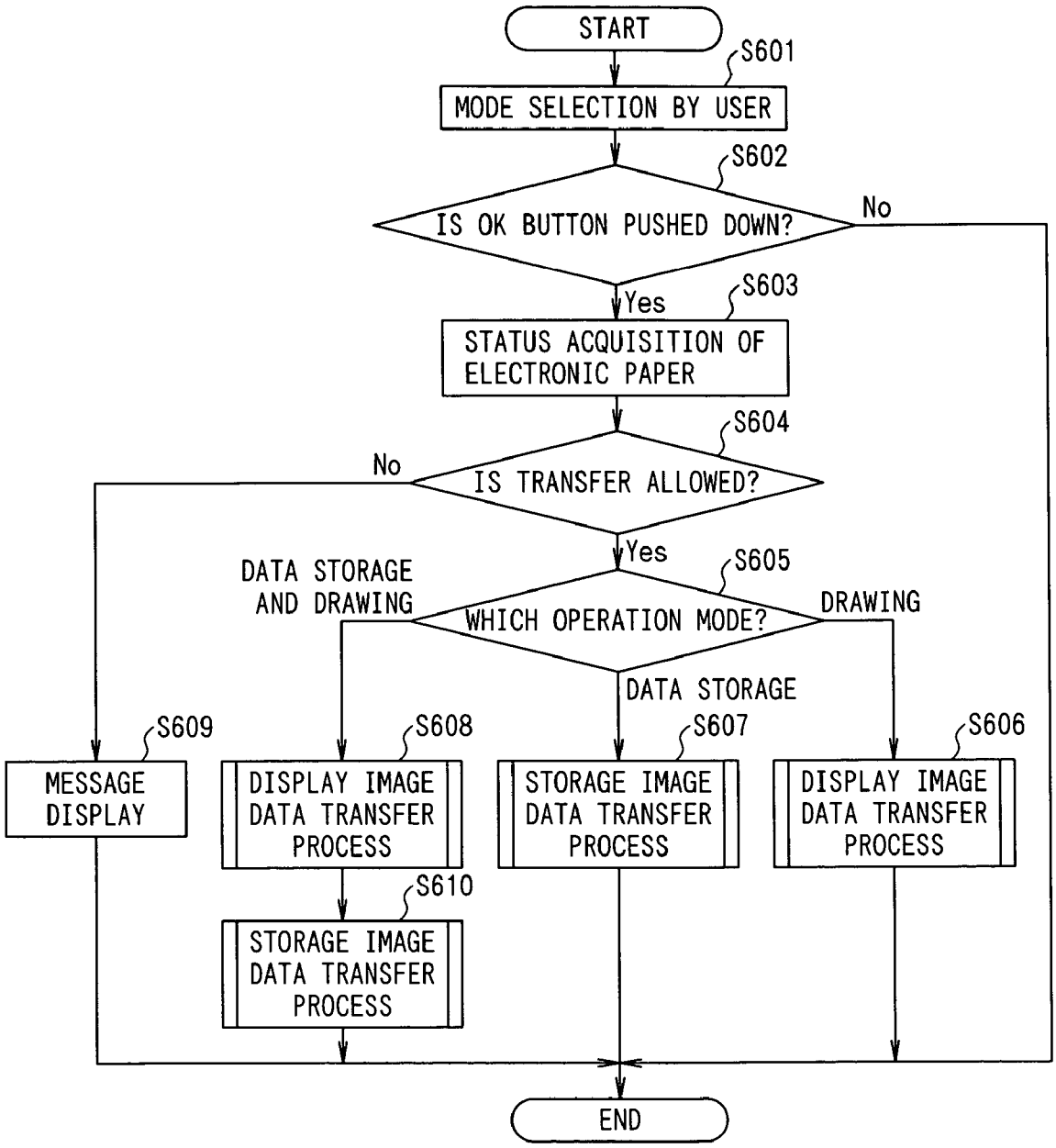
FIG. 6 is a flow chart for describing operations of a printer driver of a PC in a display system of an embodiment of the present invention.

Next, operations of the above described display system of the present embodiment will be described with reference to a flowchart. FIG. 6 is a flow chart for describing operations of the printer driver 305 of the PC 1 in the display system of the present embodiment. The printer driver 305 on standby starts in the case where a user proceeds with transfer of image data to the electronic paper 2 and starts the process. And, the user selects any of the operation modes through the inputting portion 311 (S601), then whether or not the selected operation mode has been fixed is determined by whether or not the OK button has been pushed down (S602). In case of the OK button having been pushed down (S602: Yes), communication to electronic paper 2 is implemented so that the status is acquired and the state of the electronic paper 2 is detected (S603).

Here, in the case where the OK button is not pushed down in a predetermined lapse of time period (S602: No), the process shown as the flow chart in FIG. 6 comes to an end and will be on standby for occurrence of an event.

The printer driver 305 determines based on the acquired status whether or not image data can be transferred to the electronic paper 2 (S604). As a result of determination, in the case where no image data can be transferred due to circumstances such as size and format etc. of the image data (S604: No), message indicating that transfer is not feasible is displayed to the user (S609). Based on message, a user recognizes that image data cannot be transferred, and can change conditions to transfer image data again.

On the other hand, in case of transfer of image data being feasible (S604: Yes), the decided operation mode is determined (S605). As a result of determination, in case of the operation mode being "display present page" (S605: drawing), the printer driver 305 transfers, as display image data, the image data for the pages being presently displayed on the display 101 (S606).

In addition, in case of the operation mode being "transfer document in its entirety" (S605: data storage), image data related to all the pages of the document presently being displayed on the display 101 are transferred to the electronic paper 2 as storage image data (S607). Moreover, in case of the operation mode being "display present page/transfer document in its entirety" (S605: data storage and drawing), the display image data are transferred (S608) and the storage image data are transferred (S610).

Figure 7:
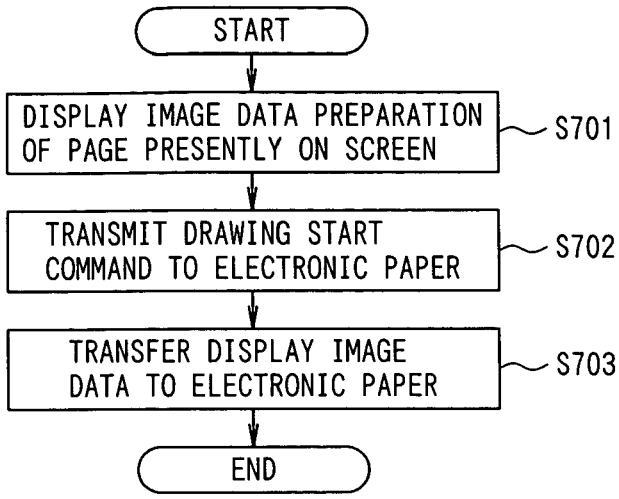
FIG. 7 is a flow chart for describing a transfer process of display image data shown in Step S605 in FIG. 6 further in detail.

FIG. 7 is a flow chart for describing a transfer process of display image data shown in Step S605 in FIG. 6 further in detail. In case of transferring the display image data, the printer driver 305 prepares the display image data of the pages being displayed presently (S701). And, a drawing command is transmitted to the electronic paper 2 (S702) and drawing of the image data is instructed. Subsequently, the display image data are transferred to the electronic paper 2 (S703).

Figure 8:
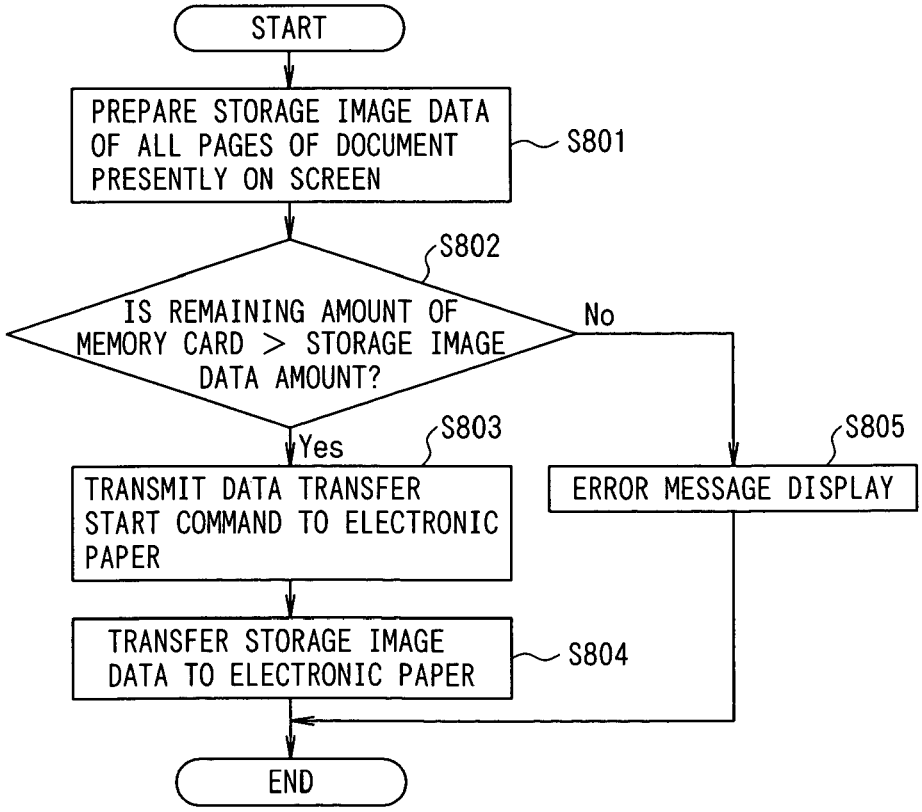
FIG. 8 is a flow chart for describing transfer of stored image data shown in Step S606 in FIG. 6.

FIG. 8 is a flow chart for describing transfer of storage image data shown in Step S606 in FIG. 6. In case of transferring the storage image data, the printer driver 305 prepares storage image data related to all the pages of the document presently being displayed (S801). In addition, it is determined whether or not the remaining capacity amount of the memory card 3 is larger than the amount of storage image data to be stored (S802), and as a result of determination, in case of determination that the remaining capacity amount of the memory card 3 is smaller than the amount of storage image data (S802: No), error message is displayed to notify the user that image data cannot be stored under the circumstances (S805).

In addition, in Step S802, in case of determination that the remaining capacity amount of the memory card 3 is larger than the amount of storage image data (S802: Yes), a data transfer starting command is transmitted to the electronic paper 2 (S803) to notify that the storage image data is being transmitted to come in right now to the electronic paper 2. Subsequently, the storage image data are transferred (S804) and the process of storage image data transfer comes to an end.

Figure 9:
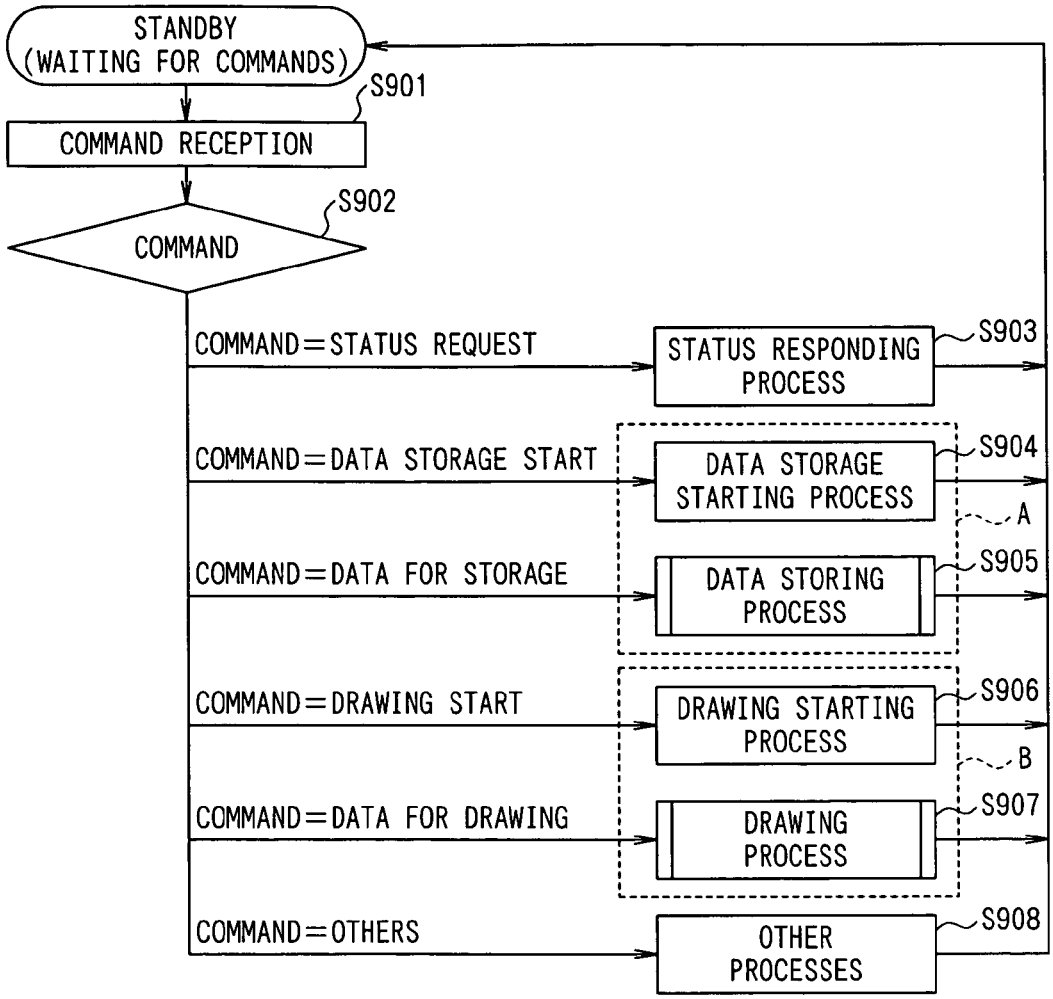
FIG. 9 is a flow chart for describing an operation in the electronic paper side in a display system of the present embodiment.

FIG. 9 is a flow chart for describing an operation in the electronic paper 2 side in a display system of the present embodiment. The flow chart shown in FIG. 9 is executed by cooperation of a command analyzing program 300, an image data displaying program 302 and image data storing and reading program 304. In the drawing, the process executed by the image data displaying program 302 is enclosed with dashed lines and is specified by the symbol A. In addition, the process executed by the image data storing and reading program 304 is enclosed with dashed lines and is specified by the symbol B.

In receipt of the command (S401), the electronic paper 2 starts operations from the standby state. And, the command analyzing program 300 analyzes the content of the command (S902), and based on the result of determination, executes the rest of the process.

That is, in the case where the command analyzing program 300 determines that the command in receipt is the one that the PC 1 is requiring the status of the electronic paper 2 (S902: command=status request), a status responding process of returning the present status to the PC 1 is executed (S903).

In addition, in the case where the command analyzing program 300 determines that the command in receipt is the one that the PC1 is requiring start of storing storage image data (S902: command=start of data storing), the image data storing and reading program 304 proceeds with start of storing the incoming transferred storage image data (S904). And, when the command analyzing program 300 determines that a command requesting for execution of storing data has been transferred and arrived (S905: command=data for storage), the image data storing and reading program 304 proceeds with data storage of storing the transferred storage image data in receipt (S905).

In addition, in the case where the command analyzing program 300 determines that the command in receipt is the one that the PC 1 is requiring start of drawing (S906: command=start drawing), the image data displaying program 302 proceeds with start of drawing the incoming transferred display image data (S906). And when the command analyzing program 300 determines that a command requesting for execution of drawing has been transferred and arrived (S902: command=data for drawing), the image data displaying program 302 executes drawing images based on the incoming transferred display image data (S907).

Moreover, in the case where the incoming transferred command other than the above described commands has arrived from the PC 1 (S902: command=others), the other processes corresponding with the contents of the command are executed in the side of electronic paper 2 (S908).

Figure 10:
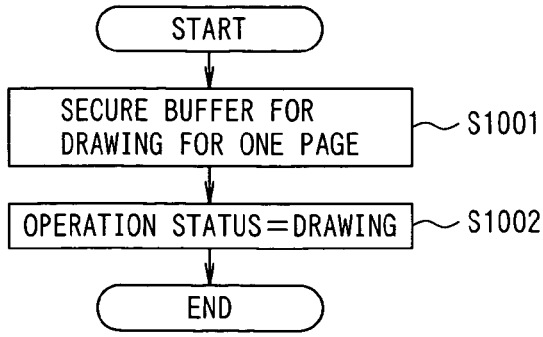
FIG. 10 is a flow chart for describing a process of starting drawing shown in Step S906 in FIG. 9.

FIG. 10 is a flow chart for describing a process implemented in the image data displaying program 302 of the electronic paper 2 and describes a process of starting drawing shown in Step S906 in FIG. 9. In case of proceeding with drawing, at first the image data displaying program 302 allocates a buffer for drawing for one page (S1001). Here, the buffer for drawing is a buffer provided for storing the display image data temporally, and can be provided to the memory 205, for example, shown in FIG. 2 in the present embodiment.

Next, the image data displaying program 302 sets the operation status of the electronic paper 2 for drawing. By setting the operation status, the electronic paper 2 can show to the PC 1 that it is presently in the midst of proceeding with drawing of the display image data.

Figure 11:
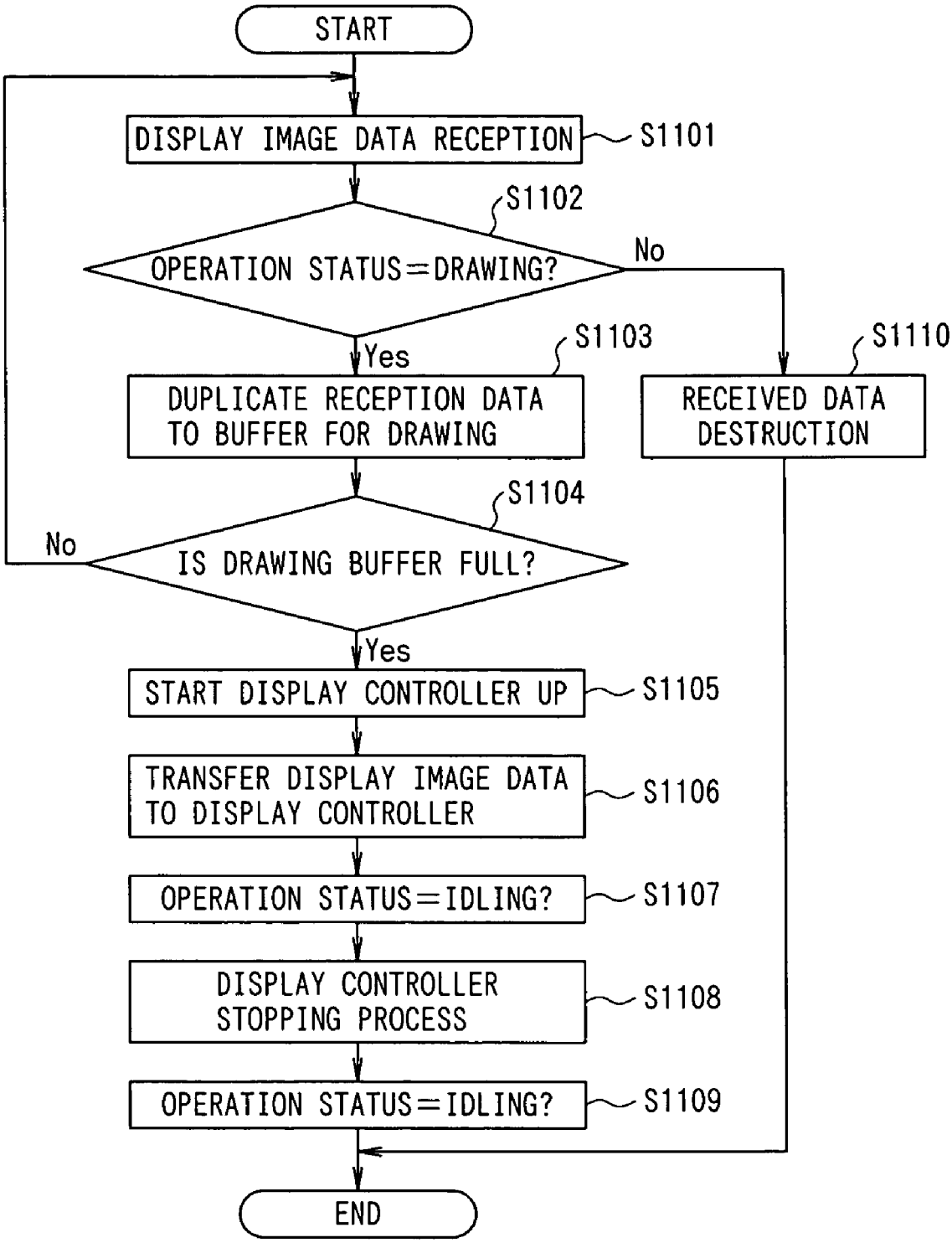
FIG. 11 is a flow chart for describing a process of drawing shown in Step S907 in FIG. 9.

FIG. 11 is a flow chart for describing a process of drawing shown in Step S907 in FIG. 9. The image data displaying program 302 receives the incoming transferred display image data from the PC 1 (S1101).

The image data displaying program 302 determines whether or not the operation status is presently set for drawing (S1102). As a result thereof, in the case where the operation status is not set for drawing (S1102: No), the data in receipt are destroyed (S1110) and it gets ready for receipt of the next data. On the other hand, in the case where the operation status is set for drawing (S1102: Yes), the display image data in receipt are duplicated to the buffer for drawing (S1103). And, whether or not the allocated drawing buffer is full is determined (S1104). In the present embodiment, the drawing buffer is allocated for one page, and therefore, at the point of time when the drawing buffer gets full, the display image data for one page are stored. Therefore, in the present embodiment, while it is determined in the step S1104 that the drawing buffer is not full yet, reception of the display image data goes on (S1104: No).

In addition, in the case where the drawing buffer 1104 is determined to be full in the Step S1104 (S1104: Yes), the image data displaying program 302 starts the display controller 201 up. And, the buffered display image data are transferred to the started display controller 201 (S1106).

Here, the display controller 201 selectively applies voltage to the electrodes of the memory-type display screen 102 based on the transferred image data. In the memory-type display screen 102, a portion where orientation direction in the range corresponding with the voltage-applied electrode transfers to give rise to a portion different in optical transmissiveness so that an image based on the image data is drawn on the memory-type display screen 102.

When transfer of the display image data is over, a process for stopping the operation of the display controller 201 is implemented (S1108). Subsequent to the stop of the display controller 201, the image data displaying program 302 sets the operation status for idling again and finalizes the process.

The above described present embodiment transfers only the display image data in case of using the memory-type display screen 102 for a subdisplay of a PC 1 etc. in a display system comprising the memory-type display screen 102, and can omit a time period or a process required for transferring and storing the storage image data. In addition, in case of using the liquid crystal display screen as an electronic book etc., it transfers only the image data to be stored and can omit a time period or a process required for displaying images. The present embodiment like this can provide with a display system, that is capable of switching the method of data transfer to electronic paper corresponding with a utility aspect such as PC's output media or electronic book and of operating in conformity with the aspect of electronic paper, and a data transfer method thereof.

In addition, the present embodiment transfers the storage image data and the display image data separately, and thereby can execute display and storage of the image data concurrently. In addition, the operation of transferring both of the storage image data and the display image data can be realized by selecting display and storage transfer mode that transfers the storage image data and the display image data consecutively. Therefore, both of the display image data and the storage image data can be transferred with just one-time operation.

Moreover, in this occasion, the present embodiment transfers the display image data in advance and afterwards transfers the storage image data. Therefore, while an image is being drawn or updated on the memory-type display screen 102, the storage image data can be stored and a user will never be annoyed on the time period required for storage of image data. The present embodiment like this is an advantageous configuration for the memory-type display screen 102 that requires more time for drawing and updating images than the display 101.

What is claimed is:

1. A display system comprising:

a display apparatus having a liquid crystal display screen of displaying images with memory-type liquid crystal and an image data storing portion of storing image data used for image forming; and an image data supplying apparatus including a transfer section of attaining or preparing image data and transferring the image data to said display apparatus, wherein said transfer section transfers at least one of display image data to be used for forming images displayed in said liquid crystal display screen and storage image data to be stored in said image data storing portion as data separate from the other, wherein said image data supplying apparatus further comprises a transfer mode selecting portion of selecting a mode of transferring image data with said transfer section, and said transfer mode selecting portion has a consecutive transfer section of selecting display and storage transfer mode that transfers said display image data and said storage image data consecutively.

2. The display system according to claim 1, wherein said image data supplying apparatus is a personal computer including a display screen and, in case of said image data being configured on a page-by-page bases, said transfer section transfers display image data to said display apparatus with a data amount displayed on said display screen as one page as a unit.

3. The display system according to claim 1, wherein said image data supplying apparatus is a personal computer including a display screen, and said transfer section transfers, to said display apparatus, display image data in a data amount displayable as one screen on said display screen as a unit.

4. The display system according to claim 1, wherein, in case of said display and storage transfer mode being selected in advance, said consecutive transfer section transfers said storage image data after transfer of said display image data.

5. A computer-readable recording medium for storing a program for causing a computer to execute an image data transfer method of transferring image data to a display apparatus having a liquid crystal display screen of displaying images with memory-type liquid crystal, comprising:

a display image data transfer step of transferring display image data that are used for forming images to be displayed on said liquid crystal display screen and are destroyed after the image forming to said display apparatus;

a stored image data transfer step of transferring storage image data to be stored in said display apparatus to said display apparatus after transfer of said display image data by said display image data transfer step, and a transfer mode selecting step of selecting a mode of transferring image data with said display image data transfer step and said stored image data transfer step, and said transfer mode selecting step has a consecutive transfer step of selecting display and storage transfer mode that transfers said display image data and said storage image data consecutively.

6. The computer-readable recording medium for storing the program for causing a computer to execute an image data transfer method according to claim 5, wherein, in the case where display image data are transferred from a personal computer including a display screen to said display apparatus and display image data to be transferred are configured on a page-by-page bases as a unit, in the above described said display image data transfer step, image data covering one page being displayed on said display screen are transferred.

* * * * *